US006253899B1

(12) United States Patent
Bellis

(10) Patent No.: US 6,253,899 B1
(45) Date of Patent: Jul. 3, 2001

(54) SHEET HANDLING APPARATUS

(75) Inventor: Robert David Bellis, Oldham (GB)

(73) Assignee: Innovative Technology Limited (GB)

( * ) Notice: Subject to any disclaimer, the term of this patent is extended or adjusted under 35 U.S.C. 154(b) by 0 days.

(21) Appl. No.: 09/388,247

(22) Filed: Sep. 1, 1999

(30) Foreign Application Priority Data

Sep. 3, 1998 (GB) ..... 98307086

(51) Int. Cl.[7] ..... G07D 7/00; B65H 29/02

(52) U.S. Cl. ..... 194/206; 271/85; 271/177

(58) Field of Search ..... 194/206, 207, 194/200; 271/85, 177, 178, 204; 414/792.9, 907

(56) References Cited

U.S. PATENT DOCUMENTS 3,831,932 * 8/1974 Conrad ..... 271/85 X
4,448,408 * 5/1984 Faltin ..... 271/204 X
4,535,794 8/1985 Bellis et al. .
4,886,265 * 12/1989 Wetter ..... 414/907 X
5,116,037 5/1992 Gerlier et al. .
5,156,393 10/1992 Erkisson .

FOREIGN PATENT DOCUMENTS 0 803 845 A1 10/1997 (EP) .

* cited by examiner

*Primary Examiner*—F. J. Bartuska
(74) *Attorney, Agent, or Firm*—Killworth, Gottman, Hagan & Schaeff, LLP

(57) ABSTRACT

A sheet handling apparatus, such as a banknote stacker, comprises a carriage (23) that collects sheets by gripping their leading edges with jaws (35, 36) and transports them to a stack (6). The carriage (23) has a pair of driven wheels (32, 34) that push back the stack (6) so that the new sheet can be deposited. The wheels (32, 34) are driven so that their points of contact with the top sheet in the stack (6) have zero velocity relative to the top sheet of the stack (6). Thus, the top sheet in the stack (6) is not crumpled as the carriage (23) passes over the top of the stack (6).

11 Claims, 6 Drawing Sheets

SHEET HANDLING APPARATUS

DESCRIPTION

The present invention relates to an apparatus for storing flexible sheets, comprising a stacker for maintaining a stack of sheets and a sheet path extending from a sheet entry point across the top of the stacker's stack space.

A known storage device for banknotes comprises a box which has a slot extending centrally along one wall. A platform is mounted within the box on a spring which pushes the platform towards the slot. When a banknote is to be put into the box, it is placed flat over the slot and then pressed along its centre line. The central part of the banknote then enters the box and presses against the platform, pushing it down. The edges of the banknote eventually follow the central portion through the slot.

A problem with such storage devices is that they are not well adapted for storage of notes of different sizes. For instance, a box having a slot sufficiently wide to receive a wide banknote may well be so wide that narrower notes would fall out.

It is an aim of a first aspect of the present invention to overcome the aforementioned problem.

An apparatus according to the present invention is characterised by a carriage for pulling a sheet along the sheet path for deposition at the stack top location of the stacker, wherein the carriage passes over the stack top location when pulling a sheet and is configured to contact a top sheet of the stack with contact means arranged to have zero velocity with respect to the top sheet of the stack as the carriage passes. In such an apparatus, a new sheet is dragged to the top of the stack. Normally, this would result in the top sheet of the stack crumpling as the carriage passes. This is avoided in the present invention by arranging the carriage such that its points of contact with the top sheet have zero velocity relative thereto.

The term "top of the stack" has been used for convenience and means the end of the stack to which new sheets are added, irrespective of the orientation of the stack. Related terms should be construed accordingly.

It is preferred that the points of contact be driven in some way to avoid the need for expensive very low friction bearings. Conveniently, the contact means comprises a wheel driven such that the velocity of its circumference is equal and opposite to the velocity of the carriage. However, the contact means could comprises driven caterpillar-type tracks or feet.

Preferably, the stacker includes spring means for urging the stack towards the sheet path.

The contact means could be driven using a dedicated motor. However, it is preferred that the apparatus include a rack extending along that part of the sheet path which extends across the stack top location and the contact means be driven by a pinion gear which engages the rack.

Preferably, the carriage is provided with gripping means for gripping the leading edge of a sheet being inserted at the entry point. However, gripping means for gripping the side edges of a sheet or suction means for gripping a face of a sheet could be used. Preferably, the gripping means comprises a pair of jaws. More preferably, the jaws are biased closed, one jaw is provided with a lever arm and actuator structures, which may be stationary, are provided in association with the entry point and the stacker such that the lever is operated by the actuator structures to open the jaws at the entry point for collection of a sheet and at the stacker for deposition of a sheet. Alternatively, the jaws can be operated by a solenoid mounted to the carriage. A combination of these techniques could also be used. That is an actuator structure may be provided at one end of the sheet path and some other means for opening the jaws may be provided at the other end.

An apparatus according to the present invention preferably includes a motor for driving the carriage, a tape spool drivingly coupled to the motor and a tape extending between the spool and the carriage such the carriage can be driven along the sheet path in either direction by the motor. The motor may be reversible or a transmission providing forward and reverse gears may be used.

Preferably, the carriage includes gripping means for gripping a sheet to be pulled along the path and the apparatus including guide means arranged such that the gripping means is withdrawn away from the sheet path when travelling towards the entry point. More preferably, the carriage includes a guide projection and the guide means comprises a side panel having an arrangement of guide grooves for receiving the guide projection, the guide grooves comprising a first groove at the stacker end of the sheet path which bifurcates into second and third grooves that extend side by side towards the entry point and combine to form a fourth groove before reaching the entry point. The guide projection is preferably mounted on an element of the gripping means so that the gripping means are withdrawn from the sheet path when the carriage is returning unloaded to the entry point. Thus, the carriage as a whole does not have to change its route.

An embodiment of the present invention will now be described, by way of example, with reference to the accompanying drawings, in which.

Figure 1:
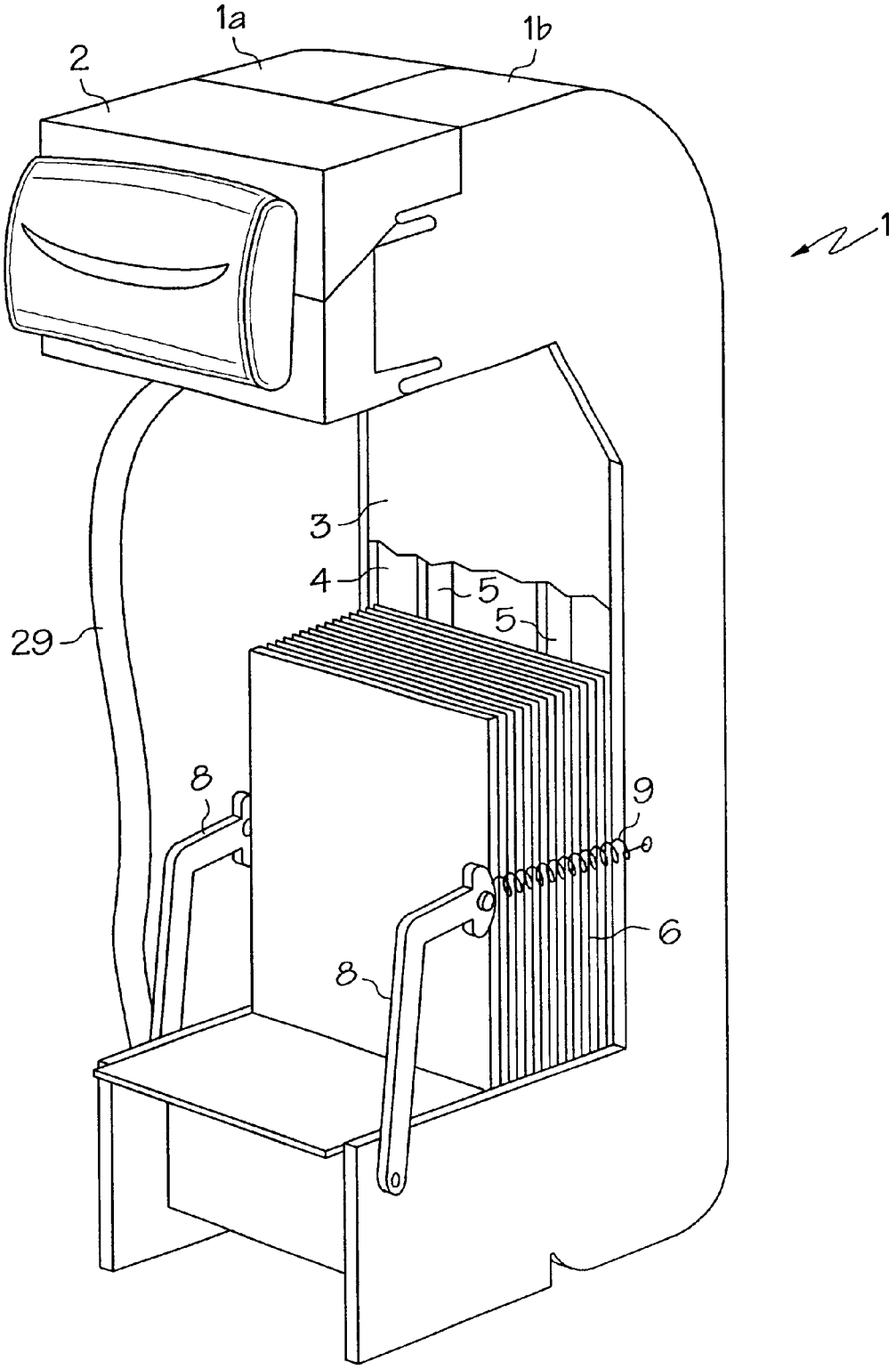
FIG.1 is a perspective view of a banknote validator and an apparatus according to the present invention.

Referring to FIG. 1, an apparatus according to the present invention comprises a generally L-shaped housing 1. The top of the housing 1 is curved forward to mate with the back of a banknote validator 2. The housing 1 comprises first and second plastic, moulded structures 1*a*, 1*b* which define the back, the top, the bottom and the sides of the apparatus. The major part of the front of the apparatus is defined by a front panel 3 (shown partially cut away). A sheet steel member 4 extends up the apparatus behind the front panel 3, thereby defining a sheet path which also curves towards the back of the validator 2. The lower part of the steel member 4 is bent forward through 90° and forms the roof of the base of the apparatus and the floor of a sheet-stacking zone. A pair of parallel slots 5 extend along the upright portion of the steel member 4.

A plurality of sheets 6, such as banknotes, are stacked in the sheet-stacking zone. A plate 7 is hingedly mounted to a pair of dog-legged arms 8 which are pivotably mounted on either side of the base of the apparatus. The upper ends of the arms 8 are coupled by springs 9 to the sides of the upright portion of the apparatus. Consequently, the plate 7 presses the sheets towards the steel member 4, which is exposed at the stacking zone.

A ribbon cable 29 extends between the validator 2 and the base of the apparatus.

Figure 2:
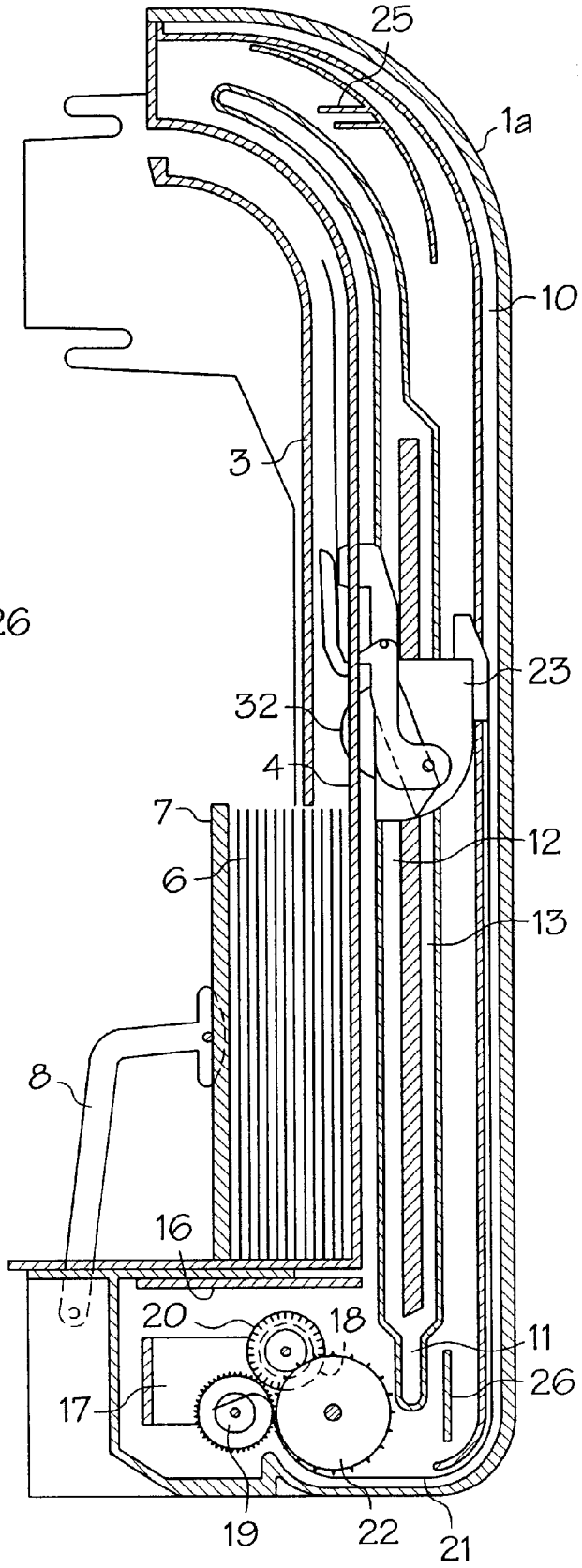
FIG. 2 is a sectional view of the apparatus of FIG. 1.

Referring to FIG. 2, the first moulded structure 1*a* has a channel 10 extending along its rear edge from its top to substantially its bottom. An arrangement of grooves is formed on the inside of the side wall portion of the first moulded structure 1*a*, towards its front edge. The arrangement of grooves comprises a first, short groove 11 at a position below and behind the sheet-stacking zone. At its upper end, the short groove 11 bifurcates into second and third, parallel grooves 12, 13. The second and third grooves 12, 13 extend upwards to the point where the apparatus bends forward. At this point, the third groove 13 turns to the front and meets the second groove 12 from the side. A fourth groove 14 extends from the upper junction of the second and third grooves 12, 13 around the curve of the upper part of the apparatus.

Figure 3:
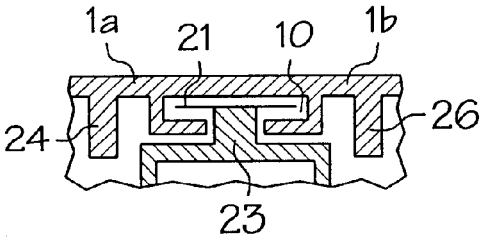
FIG. 3 is a sectional view of a detail of the back of the apparatus of FIG. 1.

A pcb 16 is mounted to the roof of the base of the apparatus. The pcb 16 supports the electronic components of the apparatus, including an optical sensor 17 at the back edge of the pcb 16. A motor 18 is mounted beneath the pcb 16 and is coupled by a gear train to a spool 19 and the toothed wheel 20 of an optical rotation sensor. A stiff tape 21 is attached at one end the spool 19. The tape 21 extends from the spool 19 around the bottom of an idler wheel 22 and into the channel 10. The distal end of the tape 21 is connected to a carriage 23. As can be seen from FIG. 3, the front of the channel 10 has a slot sufficient to allow the carriage 23 to be connected to the tape but too narrow for the tape 21 to escape through. Obscured by the channel 23 in FIG. 2 is a rack 24 (see FIG. 3), formed on the inside back face of the first moulded structure 1*a*. The rack 24 extends from the top of the moulded structure 1*a* near its front edge, down the upright portion to a point near the bottom of the channel 10.

A horizontal ridge 25 is formed on the inside of the side wall portion of the moulded structure 1*a* in its curved region. A vertical ridge 26 is formed on the inside of the side wall portion of the moulded structure 1*a* immediately behind the first groove 11. The purpose of the ridges 25, 26 will be explained below.

The second moulded structure 1*b* is internally the mirror image of the first moulded structure 1*a*.

Figure 4:
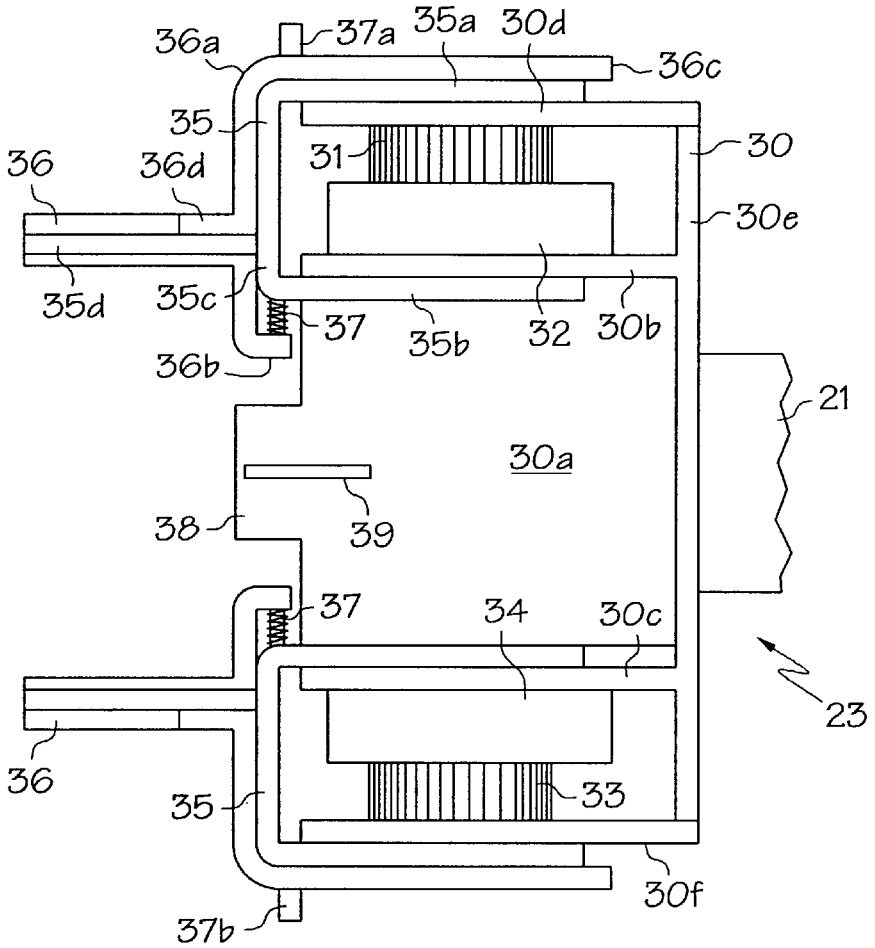
FIGS. 4 and 5 are orthogonal views of the carriage of FIG. 2.
Figure 5:
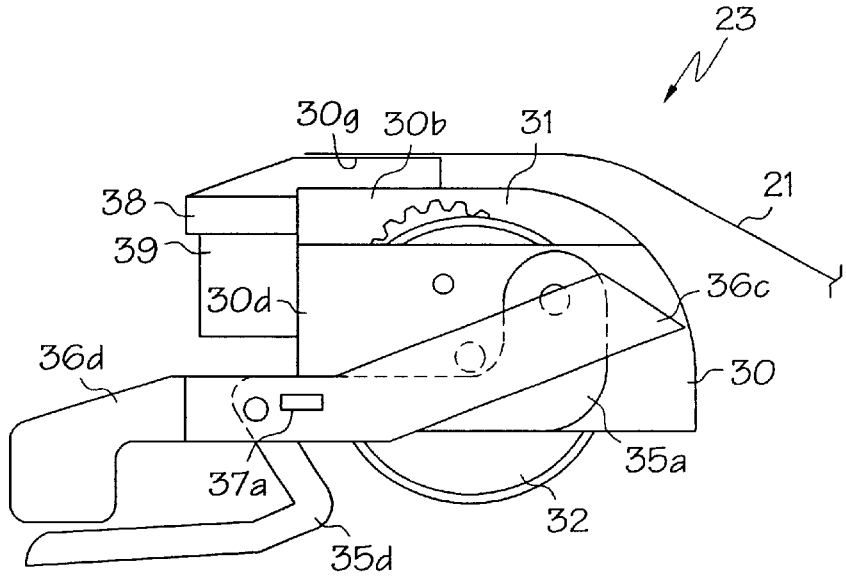
Figure 6:
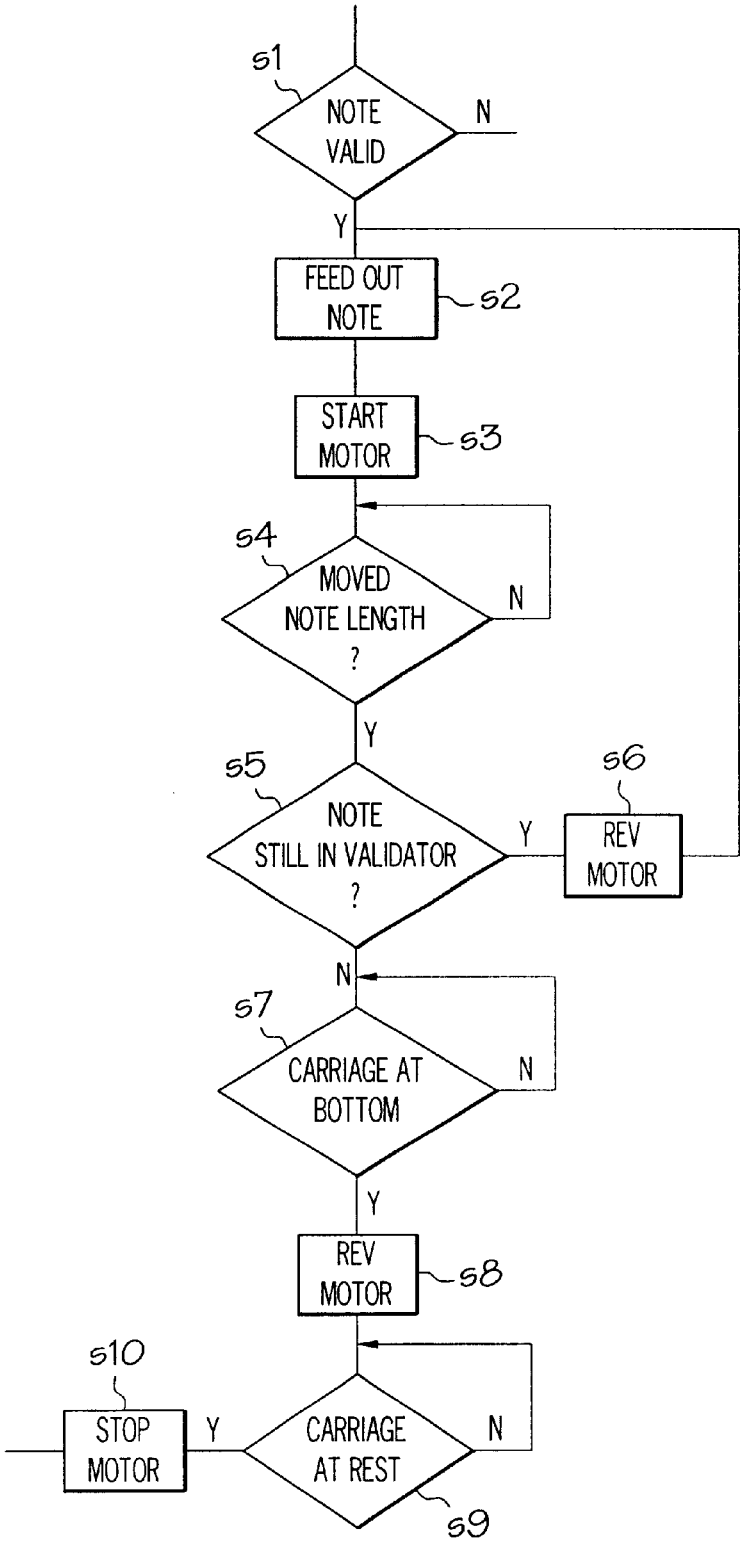
FIG. 6 is a flow chart illustrating the operation of the system of FIG. 1.

Referring to FIGS. 4 and 5, the carriage 23 includes a yoke 30 comprising a central substantially quarter-cylindrical main panel 30*a* and first and second quarter-disc-shaped side walls 30*b*, 30*c* at either side of the main panel 30*a*. A first wing panel 30*d* lies parallel to and spaced from the first side wall 30*b*. The first wing panel 30*d* is connected to the main panel 30*a* by a first lateral extension thereof 30*e*. A second wing panel 30*f* is similarly arranged on the opposite side of the main panel 30*a*.

A first toothed wheel 31 is rotatably mounted to the first wing panel 30*d* between the first wing panel 30*d* and the first side wall 30*b*. The first toothed wheel 31 projects beyond the first wing panel 30*d* so that it is partially exposed on one side but still shielded by the first side wall 30*b* on the other. A first wheel 32 is rotatably mounted to the first side wall 30*b* between the first side wall 30*b* and the first toothed wheel 31. The first wheel 32 projects beyond the first wing panel 30*d* in the opposite direction to that in which the first toothed wheel 31 projects beyond the first wing panel 30*d*. The first toothed wheel 31 has an integrated gear wheel (not shown) which is engaged with a similar gear wheel (not shown) integrated with the first wheel 32. Thus, rotation of the first toothed wheel 31 causes the first wheel 32 to rotate. A second toothed wheel 33 and a second wheel 34 are similarly arranged between the second side wall 30*c* and the second wing panel 30*f*.

A first jaw 35 includes first and second parallel arms 35*a*, 35*b* which are pivotably mounted respectively to the outer face of the first wing panel 30*d* and the inner face of the first side wall 30*b*. The distal end of the first arm 35*a* is shaped like the bottom end of a hurling stick with the pivot point in the enlarged portion. The arms 35*a*, 35*b* are joined by a crosspiece 35*c*, extending across the space between the first wing panel 30*d* and the first side wall 30*b* opposite the first lateral extension 30*e*. An L-shaped arm 35*d* extends from the crosspiece 35*c*, initially in the direction in which the first wheel 32 projects beyond the first wing panel 30*d* and then parallel to and away from the arms 35*a*, 35*b*.

A second jaw 36 includes a crosspiece 36*a* lying close to and parallel to the crosspiece 35*c* of the first jaw 35. A stub 36*b* projects from the inner end of the crosspiece 36*a* and is pivotably coupled to one end of the crosspiece 35*c* of the first jaw 35. A coil spring 37 is located between the stub 36*b* and the crosspiece 35*c* so as to bias the jaws 35, 36 in their closed configuration. An lever arm 36*c* extends parallel to and beside the first arm 35*a* of the first jaw 35 substantially to a point level with the junction between the first wing panel 30*d* and the first lateral extension 30*e*. An arm 36*d* projects from the crosspiece 36*a* in alignment with the L-shaped arm 25*d*. The distal portion of the arm 36*d* is enlarged and, at rest, contacts the distal portion of the L-shaped arm 35*d*.

A mirror-image set of jaws 35, 36 is provided on the opposite side of the carriage 23.

A pair of guide lugs 37*a*, 37*b* project outwards from first jaw of each pair of jaws adjacent to the pivot.

The tape 21 is mounted to a raised portion 30 g on the centre line of the main panel 30*a* and extends over the major part of the main panel 30*a*.

A tab 38 projects from the main panel 30*a* generally parallel to the jaws 35, 36. A flag 39 extends perpendicularly from the tab 38 in the opposite direction to the raised portion 30 g.

Referring again to FIGS. 2 and 3, when the carriage is installed, the raised portion 30 g extends into channel 10 and the toothed wheels 31, 33 engage the racks 24. The wheels 32, 34 project forward through the slots 5 (FIG. 1). The guide lugs 37*a*, 37*b* are received in the grooves 11, 12, 13, 14 and control the position of the jaws 35, 36 as the carriage 23 moves up and down the apparatus.

In the present embodiment, the apparatus is controlled by the validator 2. The electronic components of the apparatus being simply those necessary to convert control signals from the validator 2 into energising current for the motor 17 and to condition sensor signals to be sent to the validator 2. As is conventional in the art, the validator 2 includes a microprocessor and I/O devices.

The operation of the apparatus will now be described with reference to FIGS. 6 and 7*a* to 7*e*. FIG. 7 shows the jaws 35, 36 that are located beside the first moulded structure 1*a*.

Figure 7A:
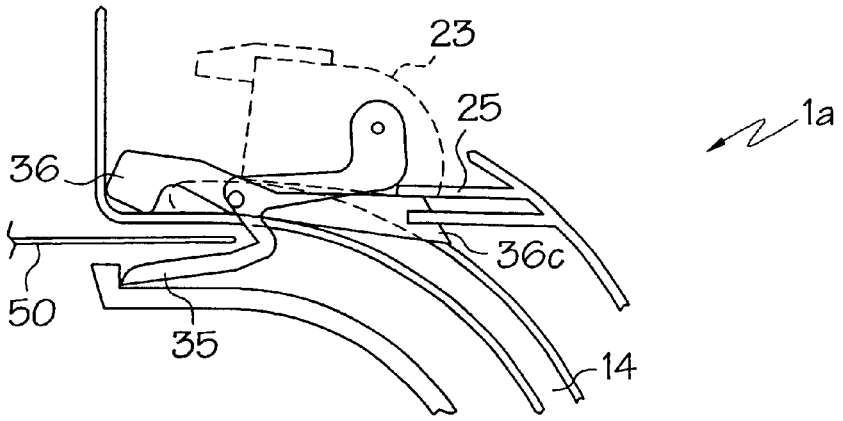
FIGS. 7*a* to 7*e* are a set of schematic views illustrating the movement of the carriage and the operation of its jaws.
Figure 7B:
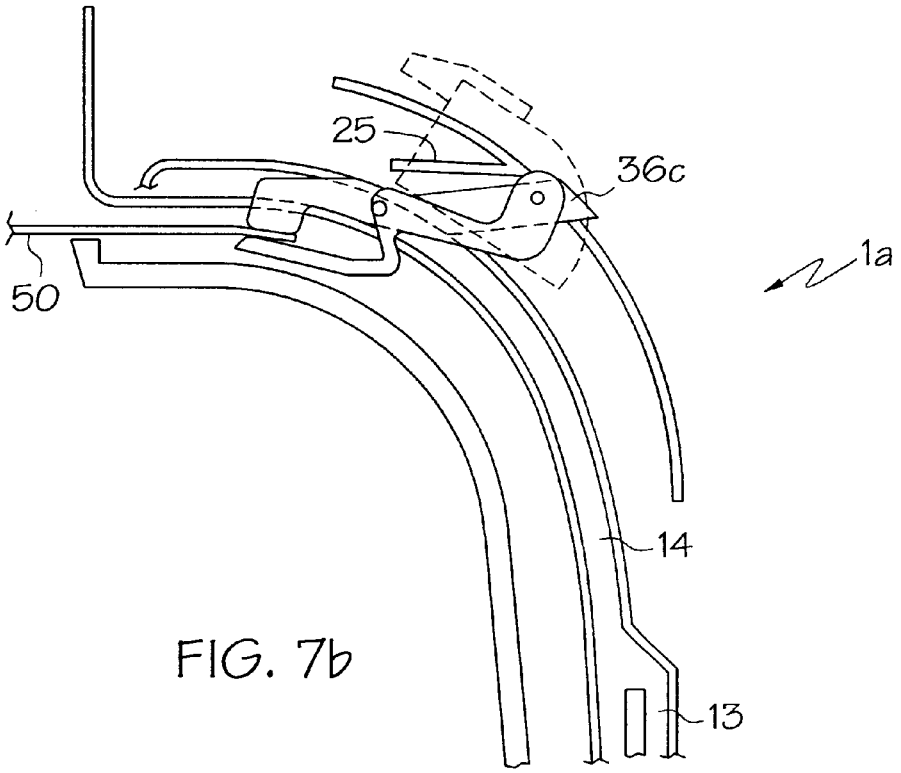
Figure 7E:
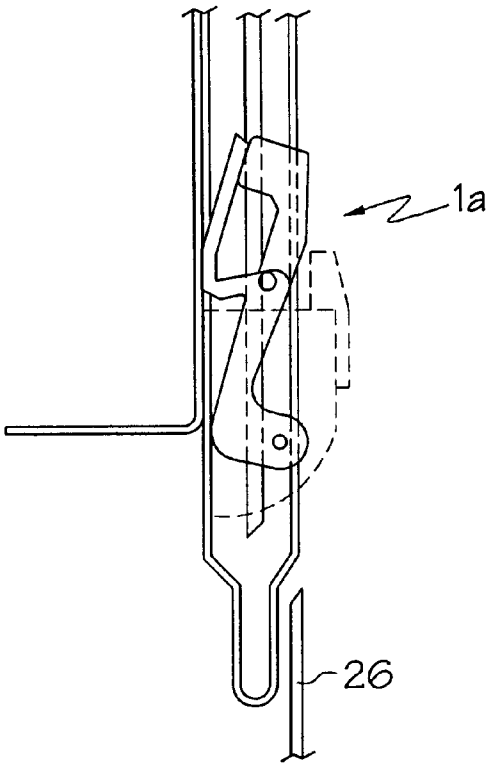

Referring to FIG. 7*a*, the carriage 23 rests at the top of the apparatus. At this position, the distal ends of the lever arms 36*c* bear against the horizontal ridges 25 which causes the jaws 35, 36 to be open. If the validator 2 now determines that a valid banknote 50 has been inserted (step s1), it starts feeding the banknote 50 into the apparatus (step s2) and starts the motor 17 (step s3) by sending a signal down the ribbon cable 29 (FIG. 1). As the motor 17 rotates, it rotates the spool 19 to wind in the tape 21. This pulls the carriage 23 down the apparatus. At the same time, the toothed wheel 20 rotates. The rotation of the toothed wheel 20 is sensed by an optical sensor which sends a stream of pulses back to the validator 2, via the ribbon cable 29, which begins to count them. Referring to FIG. 7*b*, as the carriage 23 moves away from the entrance of the sheet path, the distal ends of the lever arms 36*c* move away from the horizontal ridges 25 and can pivot, under the influence of the springs 37, relative to the first jaws 35 thereby closing the jaws 35, 36.

When the count of pulses indicates that the carriage 23 has moved a distance corresponding to the length of the banknote 50 (step s4), the validator 2 checks that the banknote has been successfully gripped by the jaws 35, 36 (step s5). If the banknote 50 has remained in the validator 2, the validator 2 reverses the direction of the motor 17 to return the carriage 23 to its starting position and withdraws the banknote (step s6) and restarts the operation at step s2.

The carriage 23 is guided as it travels down by the fourth groove 14 and then the second groove 12. The positions of these grooves ensures that the jaws 35, 36 project into the sheet path.

As the carriage 23 reaches the stacking zone, the wheels 32, 34 come into contact with the top banknote in the stack 6. The wheels 32, 34 are driven by the toothed wheels 31, 33 which are engaged with the racks 24. The gearing between the toothed wheels 31, 33 and the wheels 32, 34 is such that there is no relative motion between the points of contact between wheels 32, 34 and the banknote on the top of the stack 6. Consequently, the top banknote does not fold or become crumpled. The wheels 32, 34 also serve to push back the banknotes in the stack 6 to allow the newly validated banknote 50 to be added to the top of the stack 6.

Figure 7D:
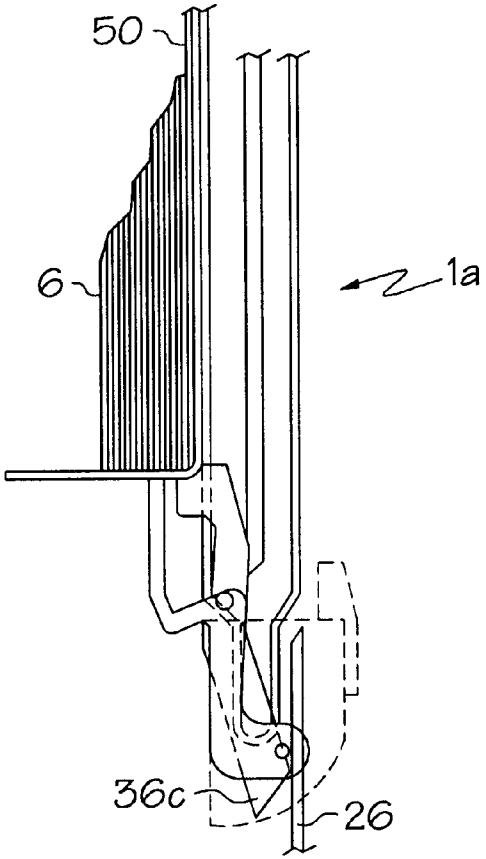
Figure 7C:
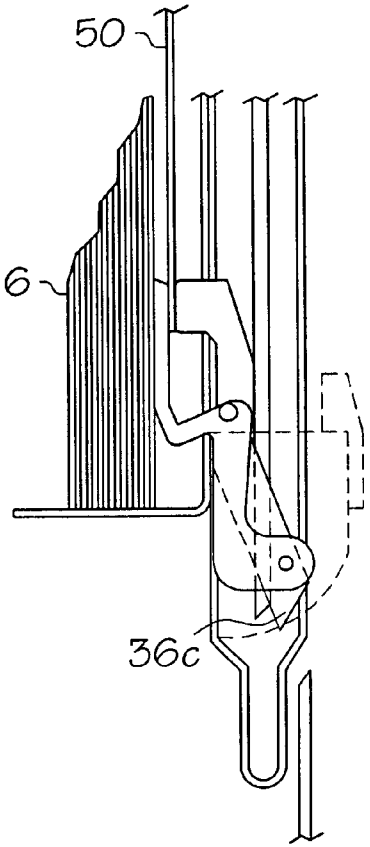

Referring to FIGS. 7*c* and 7*d*, as the carriage 23 reaches the point where the jaws 35, 36 are just clearing the stack 6, the lever arms 36*c* engage the vertical ridges 26 causing them to pivot and open the jaws 35, 36. As a result, the newly validated banknote 50 is left on the top of the stack 6. The guide lugs 37*a*, 37*b* then enter the first grooves 11.

When the carriage 23 reaches the bottom of its travel, the flag 39 (FIG. 5) cuts the beam of the optical sensor 18 (FIG. 2). This is detected by the validator 2 (step s7) which then generates signals to reverse the motor 17 (step s8). Reversing the motor 17 unwinds the tape 21 from the spool 19. The combination of the stiffness of the tape 21 and its being constrained in the channel 10 means that the carriage 23 is then pushed back up the apparatus.

The bottom end of the island between the second and third grooves 12, 13 is shaped such that, when the carriage 23 is being driven out of the first groove 11, the guide lugs 37*a*, 37*b* strike it and are deflected into the third groove 13. Consequently, the jaws 35, 36 are withdrawn from the sheet path until the carriage 23 is again being guided by the fourth groove 14. As the carriage 23 rises, the validator 2 counts the pulses produced by rotation of the toothed wheel 20 and when the count indicates that the carriage 23 is back at its rest position (FIG. 7*a*), (step s9) stops the motor 17 (step s10).

In the present embodiment, the movement of the carriage 23 closely controlled by the validator 2. It will be appreciated that the control of the carriage's movement may be performed by the apparatus itself.

It will also be appreciated that the form of the apparatus described above may be varied. In particular, the path travelled by the carriage may be extended and include additional bends.

What is claimed is:

1. An apparatus for storing flexible sheets, comprising a stacker for maintaining a stack of sheets (6) and a sheet path extending from a sheet entry point across the top of the stacker's stack space, characterised by a carriage (23) for pulling a sheet (50) along the sheet path for deposition at the stack top location of the stacker, wherein the carriage (23) passes over the stack top location when pulling a sheet (50) and is configured to contact a top sheet of the stack with contact means (32, 34) arranged to have zero velocity with respect to the top sheet of the stack as the carriage (23) passes.

2. An apparatus according to claim 1, wherein the contact means (32, 34) comprises a wheel (32, 34) driven such that the velocity of its circumference is equal and opposite to the velocity of the carriage (23).

3. An apparatus according to claim 2, including a rack (24) extending along that part of the sheet path which extends across the stack top location, wherein said wheel (32, 34) is driven by a pinion gear (31, 33) which engages the rack (24).

4. An apparatus according to claim 1, wherein the carriage (23) is provided with gripping means (35, 36) for gripping the leading edge of a sheet (50) being inserted at the entry point.

5. An apparatus according to claim 4, wherein the gripping means (35, 36) comprises a pair of jaws (35, 36).

6. An apparatus according to claim 5, wherein the jaws (35, 36) are biased closed, one jaw (36) is provided with a lever arm (36*c*) and actuator structures (25, 26) are provided in association with the entry point and the stacker such that the lever arm (36*c*) is operated by the actuator structures (25, 26) to open the jaws (35, 36) at the entry point for collection of a sheet (50) and at the stacker for deposition of a note.

7. An apparatus according to claim 6, wherein the actuator structures (25, 26) are stationary.

8. An apparatus according to claim 1, including a motor (17) for driving the carriage (23), a tape spool (19) drivingly coupled to the motor (17) and a tape (21) extending between the spool (19) and the carriage (23) such the carriage (23) can be driven along the sheet path in either direction by rotation of the motor (17).

9. An apparatus according to claim 1, wherein the carriage (23) includes gripping means (35, 36) for gripping a sheet (50) to be pulled along the path and including guide means (11,12,13, 14) for guiding the carriage (23) such that the gripping means (35, 36) is withdrawn away from the sheet path when travelling towards the entry point.

10. An apparatus according to claim 10, wherein the gripping means (35, 36) includes a guide projection (37, 38) and the guide means comprises a side panel having an arrangement of guide grooves (11, 12, 13, 14) for receiving the guide projection, the guide grooves comprising a first groove (11) at the stacker end of the sheet path which bifurcates into second and third grooves (12,13) that extend side by side towards the entry point and combine to form a fourth groove (14) before reaching the entry point.

11. A banknote handling system comprising a banknote validator (2) including means for detecting the presence of a validated banknote at an output, a banknote stacker for stacking banknotes determined to be genuine by the validator, which includes reversible banknote transport means (23) for transporting banknotes from said output to a stacking location, and monitoring means (20) for monitoring the movement of the transport means (23), wherein, on determining that a banknote is genuine, the validator (2) is responsive to the monitoring means (20) to determine when the transport means (23) has moved by a distance at least equal to the length of the banknote and to the means for detecting the presence of a banknote to reverse the transport means (23) if the banknote is detected to be still at said output.

* * * * *

UNITED STATES PATENT AND TRADEMARK OFFICE

CERTIFICATE OF CORRECTION

PATENT NO. : 6,253,899 B1
DATED : July 3, 2001
INVENTOR(S) : Bellis

It is certified that error appears in the above-identified patent and that said Letters Patent is hereby corrected as shown below:

Column 4,
Line 35, "30 g" should be -- 30g --.
Line 37, "30 g" should be -- 30g --.

Column 6,
Line 40, "apparatus according to claim 10" should be -- apparatus according to claim 9 --.

Signed and Sealed this

Twelfth Day of November, 2002

*Attest:*

*Attesting Officer*

JAMES E. ROGAN
*Director of the United States Patent and Trademark Office*